US006852251B2

(12) United States Patent
Sheng et al.

(10) Patent No.: US 6,852,251 B2
(45) Date of Patent: Feb. 8, 2005

(54) ELECTRORHEOLOGICAL FLUIDS

(75) Inventors: Ping Sheng, Kowloon (HK); Weijia Wen, Kowloon (HK); Che Ting Chan, Kowloon (HK); Weikun Ge, Kowloon (HK); Shihe Yang, Kowloon (HK)

(73) Assignee: The Hong Kong University of Science and Technology, Kowloon (HK)

( * ) Notice: Subject to any disclaimer, the term of this patent is extended or adjusted under 35 U.S.C. 154(b) by 320 days.

(21) Appl. No.: 10/243,668

(22) Filed: Sep. 16, 2002

(65) Prior Publication Data

US 2004/0051076 A1 Mar. 18, 2004

(51) Int. Cl.[7] ..... H01B 1/02

(52) U.S. Cl. ..... 252/512; 252/500; 252/518.1; 252/519.1; 252/73

(58) Field of Search ..... 252/73, 500, 512, 252/518.1, 519.1

(56) References Cited

FOREIGN PATENT DOCUMENTS

| | | |
|---|---|---|
| EP | 0 549 227 | 6/1993 |
| FR | 2 712 600 | 5/1995 |

*Primary Examiner*—Yogendra N. Gupta
*Assistant Examiner*—D. G. Hamlin
(74) *Attorney, Agent, or Firm*—Burns, Doane, Swecker & Mathis, L.L.P.

(57) ABSTRACT

There is described an electrorheological fluid comprising particles of a composite material suspended in an electrically insulating hydrophobic liquid. The composite particles are metal salts of the form $M1_xM2_{2-2x}TiO(C_2O_4)_2$ where M1 is selected from the group consisting of Ba, Sr and Ca and wherein M2 is selected from the group consisting of Rb, Li, Na and K, and the composite particles further include a promoter selected from the group consisting of urea, butyramide and acetamide.

10 Claims, 8 Drawing Sheets

ELECTRORHEOLOGICAL FLUIDS

FIELD OF THE INVENTION

This invention relates to novel electrorheological fluids formed of particles in suspension, and in particular to such a fluid having a relatively high yield stress.

BACKGROUND OF THE INVENTION

Electrorheological fluids (ER) are colloidal suspensions whose rheological properties can be varied through the application of an external electric field. In particular, under the application of a field of the order of 1–2 kV/mm an ER can exhibit a solid-like behavior, such as the ability to transmit sheer stress. This transformation from liquid-like to solid-like behavior can be very fast, of the order of 1 to 10 ms, and is reversible when the electric field is removed.

ER fluids are of interest because potentially they can provide simple, quiet, and fast interfaces between electrical controls and mechanical systems. As such they have a number of potential applications including automotive clutches, ABS brakes, shock absorption, vibration damping and micro-electric mechanical systems.

A problem with ER fluids to date, however, is that the yield strength is too low for many practical applications. The yield strength of known ER fluids is typically no more than 3 kPa at 1 kV/mm which is inadequate for most of the potential uses of ER fluids. This low yield stress in the prior art is considered to be because prior ER fluids are based upon the dielectric contrast between the solid particles and the fluid which gives rise to polarization charges upon application of the external electric field. The main drawback of this approach is that the large dielectric contrast between the particles and the fluid can give rise to a large electrical current and breakdown.

SUMMARY OF THE INVENTION

According to the present invention there is provided an electrorheological fluid comprising particles of a composite material suspended in an electrically insulating hydrophobic liquid, wherein the composite particles are metal salts of the form $M1_xM2_{2-2x}TiO(C_2O_4)_2$ where M1 is selected from the group consisting of Ba, Sr and Ca and wherein M2 is selected from the group consisting of Rb, Li, Na and K, and wherein the composite particles further include a promoter selected from the group consisting of urea, butyramide and acetamide. Viewed from another broad aspect the present invention also provides an electrorheological system comprising, an electrorheological fluid comprising particles of a composite material suspended in an electrically insulating hydrophobic liquid with a volume fraction of between 0.05 and 0.5, wherein the composite particles are metal salts of the form $M1_xM2_{2-x}TiO(C_2O_4)_2$ where M1 is selected from the group consisting of Ba, Sr and Ca and wherein M2 is selected from the group consisting of Rb, Li, Na and K, and wherein the composite particles further include a promoter selected from the group consisting of urea, butyramide and acetamide, and means for applying to the electrorheological fluid a DC electric field or an AC electrical field with a frequency of less than 1000 Hz.

Viewed from a still further aspect the present invention provides a method of manufacturing composite particles for an electrorheological fluid comprising mixing together a first solution containing M1 ions, a second solution containing M2 ions, a third solution containing Ti ions, dilute oxalic acid and a promoter, wherein M1 is selected from the group consisting of Ba, Sr and Ca, M2 is selected from the group consisting of Rb, Li, Na and K, and the promoter is selected from the group consisting of urea, butyramide, and acetamide.

BRIEF DESCRIPTION OF THE DRAWINGS

Some embodiments of the invention will now be described by way of example and with reference to the accompanying drawings, in which.

DETAILED DESCRIPTION OF PREFERRED EMBODIMENTS

Example of Particle Fabrication

The fabrication of particles for use in embodiments of the invention will now be described by way of example.

The particles are formed with the formula $M1_xM2_{2-2x}TiO(C_2O_4)_2$/Urea (or Butyramide, or Acetamide) and where x is preferably between 0.94 and 0.96 In this formula M1 may be barium, strontium or calcium, and M2 is an activator selected from the group consisting of lithium, rubidium, sodium, or potassium. Urea can be replaced by butyramide or acetamide. A specific example will now be given using barium chloride and rubidium chloride in the following amounts:

| BTR (Urea) | Weight (grams) | Water (ml) |
|---|---|---|
| Barium Chloride | 73.35 | 150 |
| Rubidium Chloride | 3.63 | 75 |
| Titanium (IV) Chloride | 33 | 300 |
| Oxalic Acid 2-hydrate | 94.56 | 750 |
| Urea | 45 | 165 |

Firstly, rubidium chloride is dissolved in distilled water at room temperature, and barium chloride is dissolved in distilled water at a temperature range of 50° C. to 70° C. At the same time oxalic acid is dissolved in water at 65° C. under an ultrasonic tanker. One hour may be required for the complete dissolution of the oxalic acid. A solution is also made of titanium (IV) chloride. Since titanium (IV) chloride is highly reactive in water, a disposable plastic dropper should be used to slowly add the liquid into the water.

The solutions thus prepared are then mixed and treated in an ultrasonic bath at 65° C. for 10 minutes while the urea is added to form a white colloid which is then cooled down to room temperature. After washing with water and filtering, the precipitant is dried (at between 30° C. and 150° C.) to remove any trace water. The resulting dried white powder is an amorphous salt metal (M1=Ba, Sr, or Ca and M2=Rb, Li, Na or K) titanium oxo oxalato with a promoter (urea or butyramide or acetamide).

Figure 1:
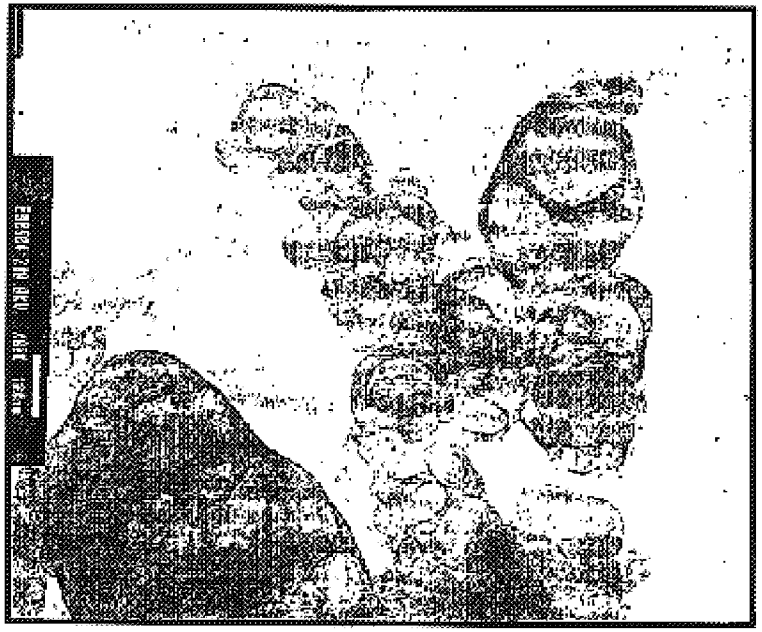
FIG. 1 is a TEM image of a particle for use in an embodiment of the invention.

FIG. 1 shows a TEM image of particles formed in accordance with the above experimental procedure. The average particle size is around 70 nm and the particles are cross-linked to form clusters.

Particles made in accordance with the above procedure were mixed with silicone oil in a volume fraction between 0.05 and 0.50, more preferably 0.10 and 0.35, to form ER fluids. Other possible oils that may be used include mineral oils, engine oils and hydrocarbon oils. The oil should have a viscosity ranging from 0.5 to 1 PaS. The resulting ER fluids were then characterized using a cell formed of two parallel electrodes. The dielectric measurements were carried out with a HP4192A LF impedance analyzer, while the rheological properties were measured by a plate/plate viscometer (Haake RS1) with a gap width of 1 mm. All experimental data was collected using Rheowin software.

In the following discussion a number of examples of materials formed in accordance with an embodiment of the invention, plus examples formed not in accordance with the invention but by way of comparison. In these examples the following nomenclature is used:

BTR-U: The particles comprise $BaCl_2$, $TiCl_4$ and RbCl with urea as the promoter.

BTR-B: The particles comprise $BaCl_2$, $TiCl_4$ and RbCl with butyramide as the promoter.

BTR-A: The particles comprise $BaCl_2$, $TiCl_4$ and RbCl with acetamide as the promoter.

STR-A: The particles comprise $SrCl_2$, $TiCl_4$ and RbCl with acetamide as the promoter.

Figure 2:
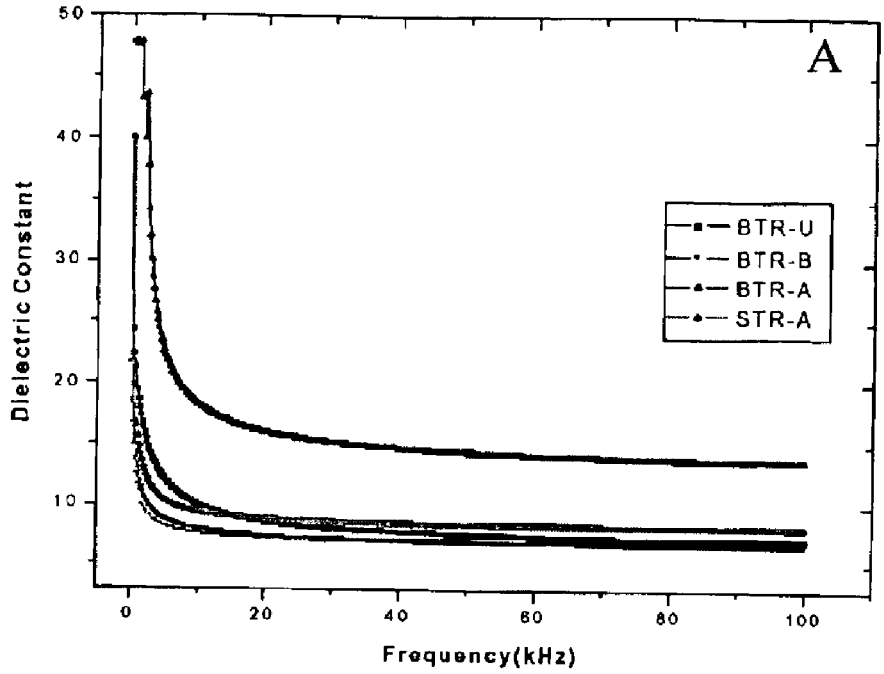
FIG. 2 shows plots of (a) the dielectric constant of embodiments of the invention as a function of frequency, and (b) conductivity as a function of frequency.
Figure 2:
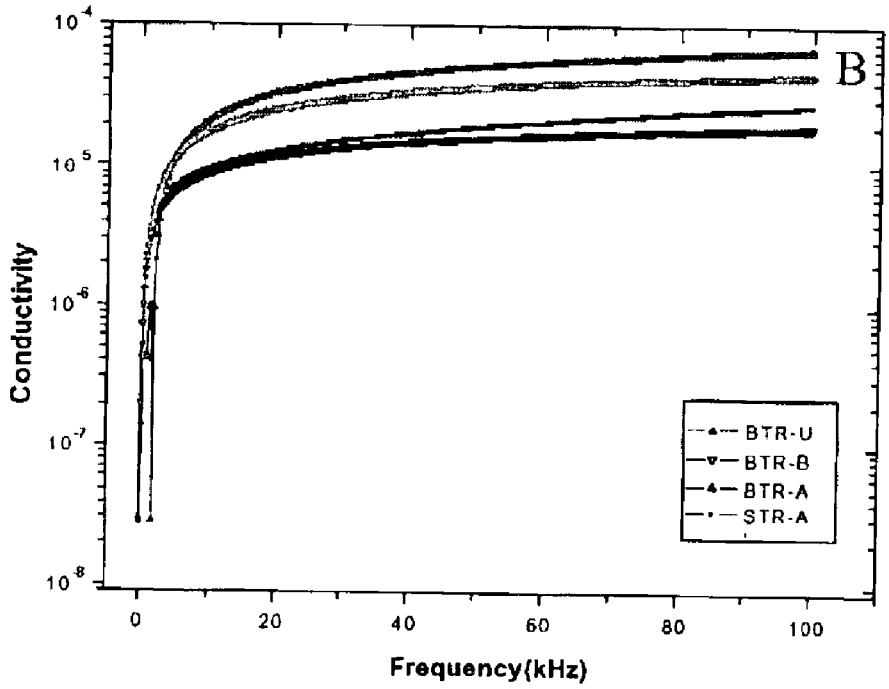

FIGS. 2(*a*) and (*b*) show how the dielectric constant (FIG. 2(*a*)) and conductivity (FIG. 2(*b*)) of the particles are all broadly similar.

Figure 3:
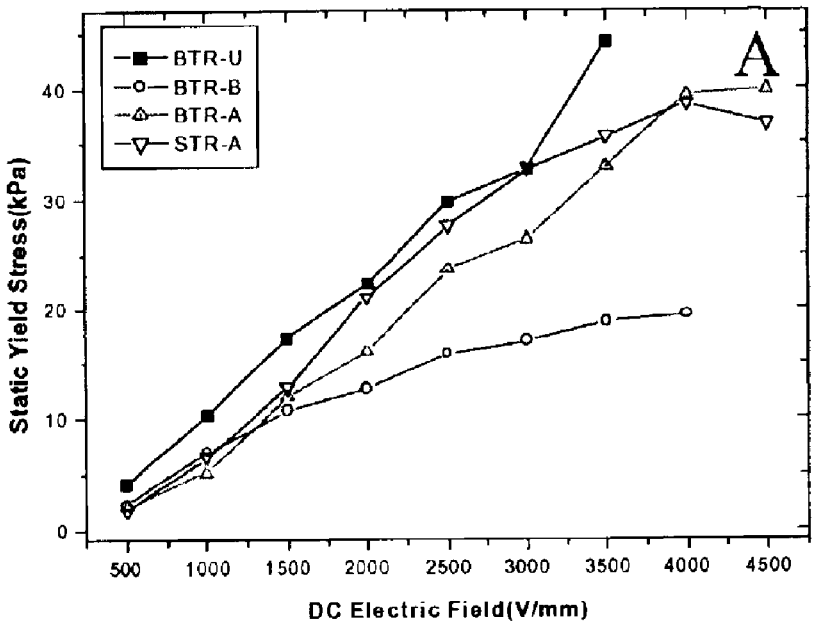
FIG. 3 shows plots of (a) the static yield stress of embodiments of the invention as a function of applied DC electric field, and (b) corresponding current densities.
Figure 3:
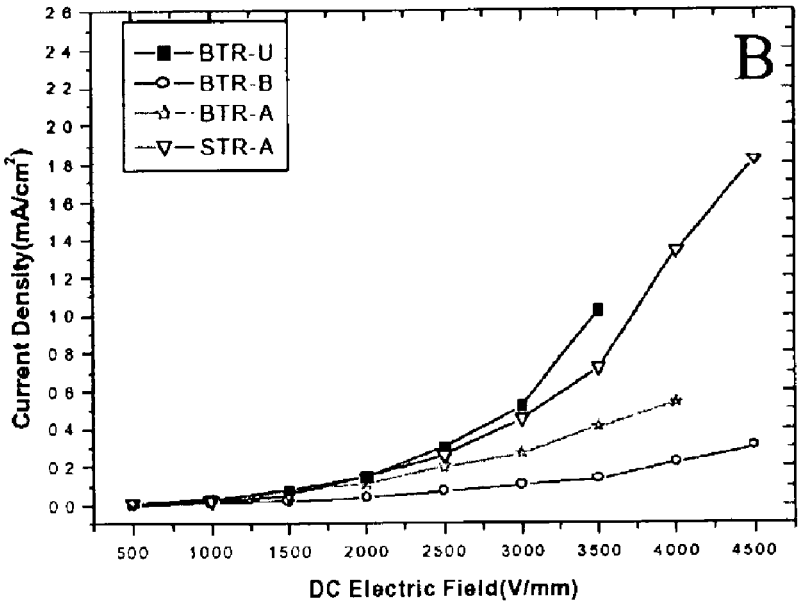
Figure 4:
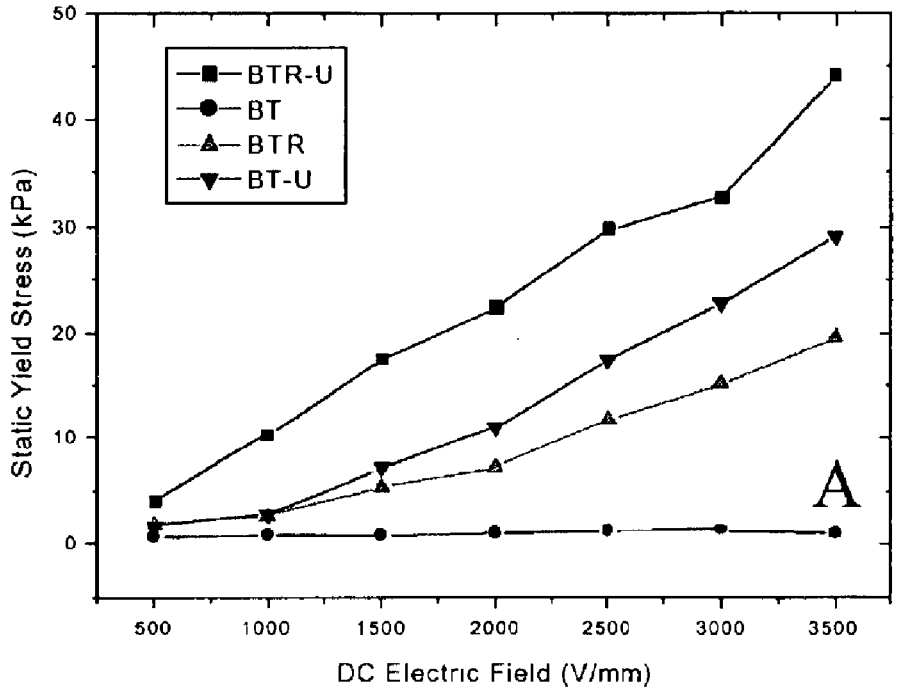
FIG. 4 shows plots of (a) the static yield stress of embodiments of the invention as a function of applied DC electric field, and (b) corresponding current densities.
Figure 4:
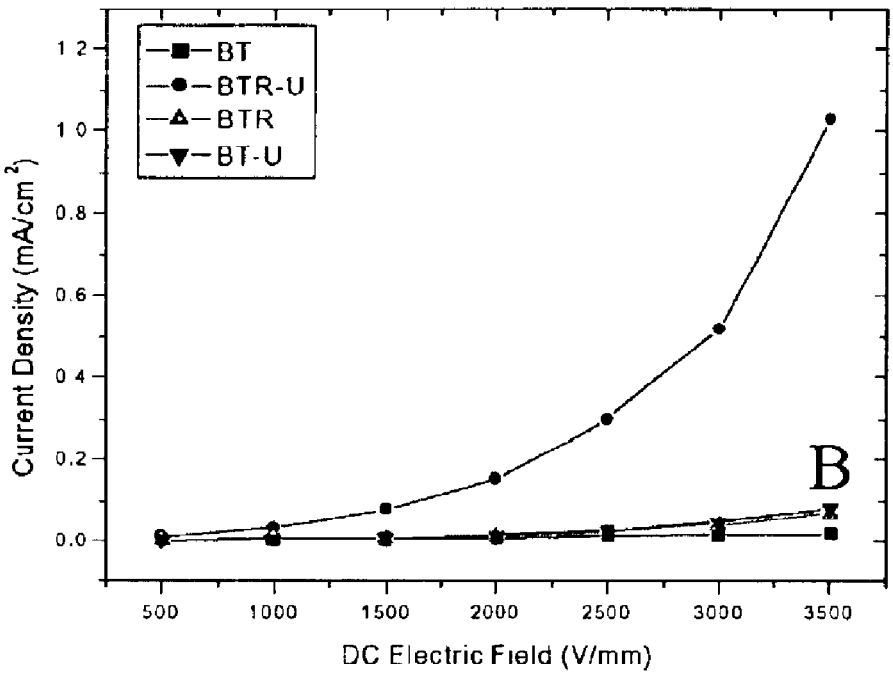

FIGS. 3(*a*) and (*b*) show respectively the static yield stress and current density as a function of an applied DC electric field. FIG. 3(*a*) shows that for all the particles the yield stress increases with the electric field up to 30 to 40 kPa at around 3.5 kV/mm. As can be seen in FIG. 3(*a*) the static yield stress of BTR-U can reach 10 kPa at only 1 kV/mm and can go as high as almost 50 kPa at a field strength of 3.5 kV/mm FIGS. 4(*a*) and (*b*) are similar to FIGS. 3(*a*) and (*b*) but compare sample BTR-U with a corresponding sample BTR formed without any urea promoter; a corresponding sample BT-U that includes a urea promoter but no M2 activator; and a sample BT that is formed without both M2 activator and promoter. It will be seen that the sample BTR-U provides by far the best performance in terms of static yield stress, followed by sample BT-U, and then BTR. Sample BT without both M2 and the promoter has effectively no electrorheological properties.

Figure 5:
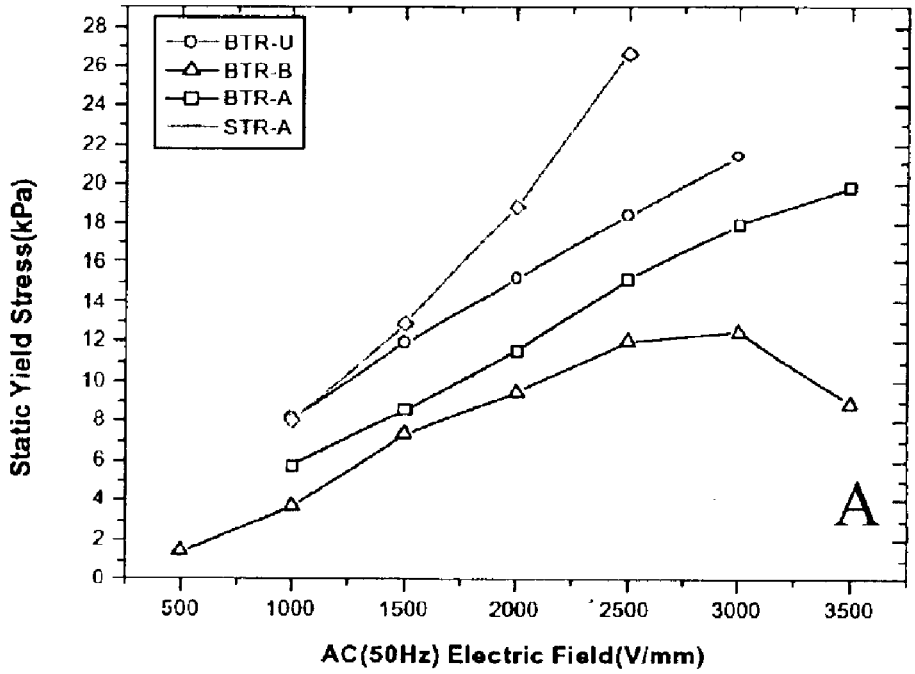
FIG. 5 shows plots of (a) the static yield stress of embodiments of the invention as a function of applied AC electric field, and (b) corresponding current densities.
Figure 5:
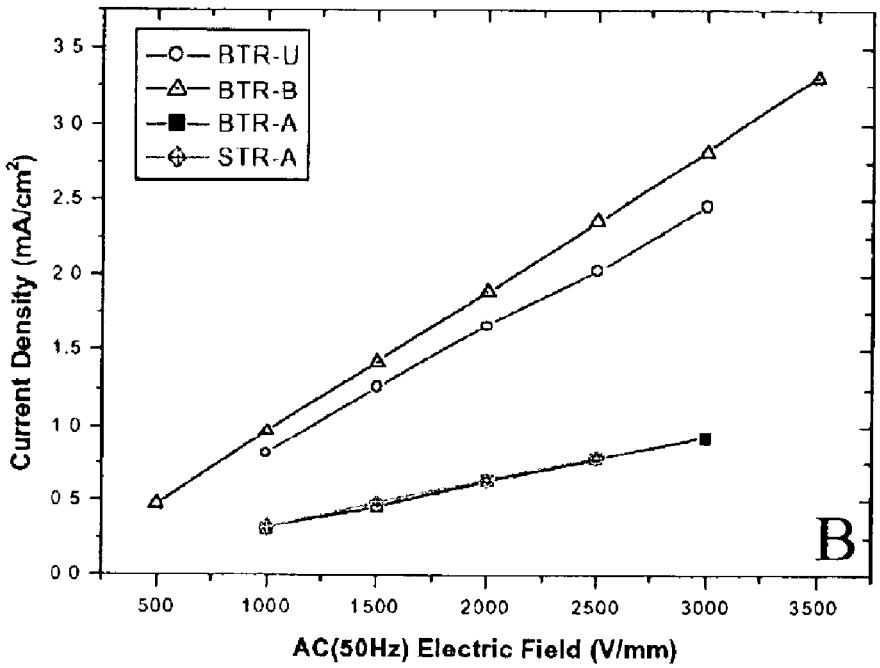

FIGS. 5(*a*) and (*b*) show (a) the static yield stress and (b) the current density for the samples of FIG. 2 and FIG. 3 in an applied AC electric field. All the samples show good yield stress properties, with sample STR-A being the best.

Figure 6:
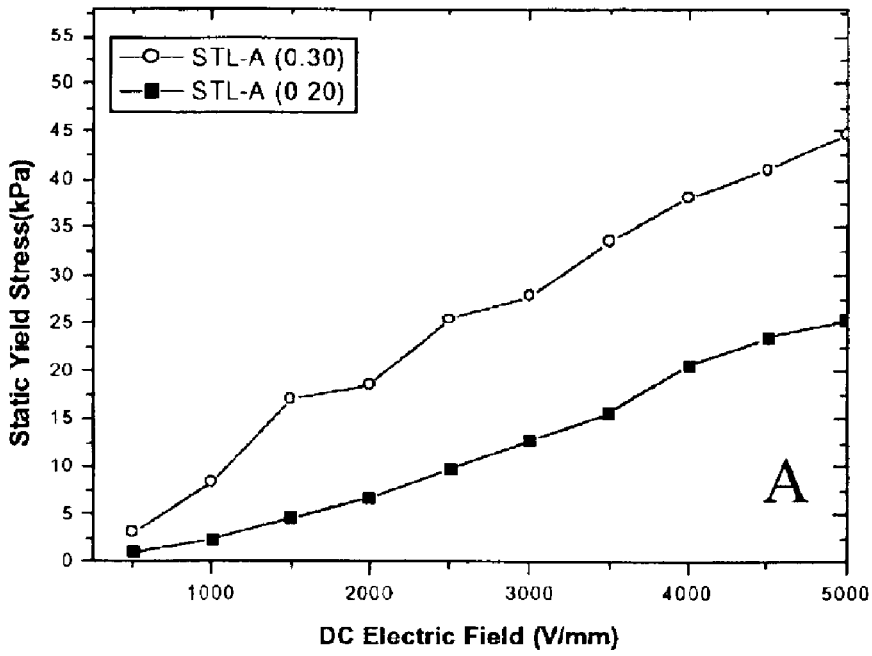
FIG. 6 shows plots of (a) the static yield stress of embodiments of the invention as a function of applied DC electric field, and (b) corresponding current densities.
Figure 6:
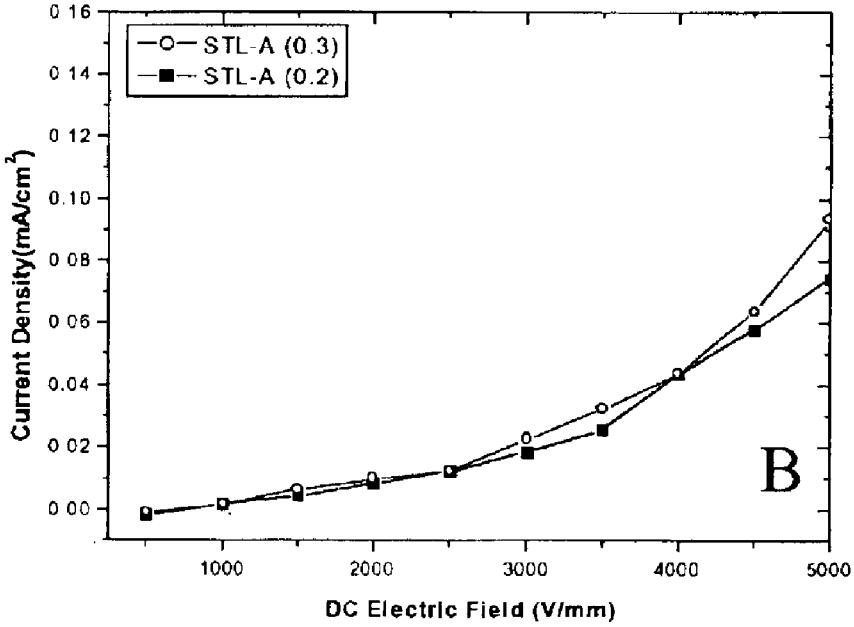

FIG. 6 plots (a) the static yield stress and (b) the current density of two samples of STL-A formed in the same manner as STR-A above but with lithium as M2. The two samples are suspended in the silicone oil at volume fractions of 0.20 and 0.30 respectively. Both samples show acceptable results, but the sample at a volume fraction of 0.30 has almost twice the static yield stress at 5 kV/mm applied DC field.

Figure 7:
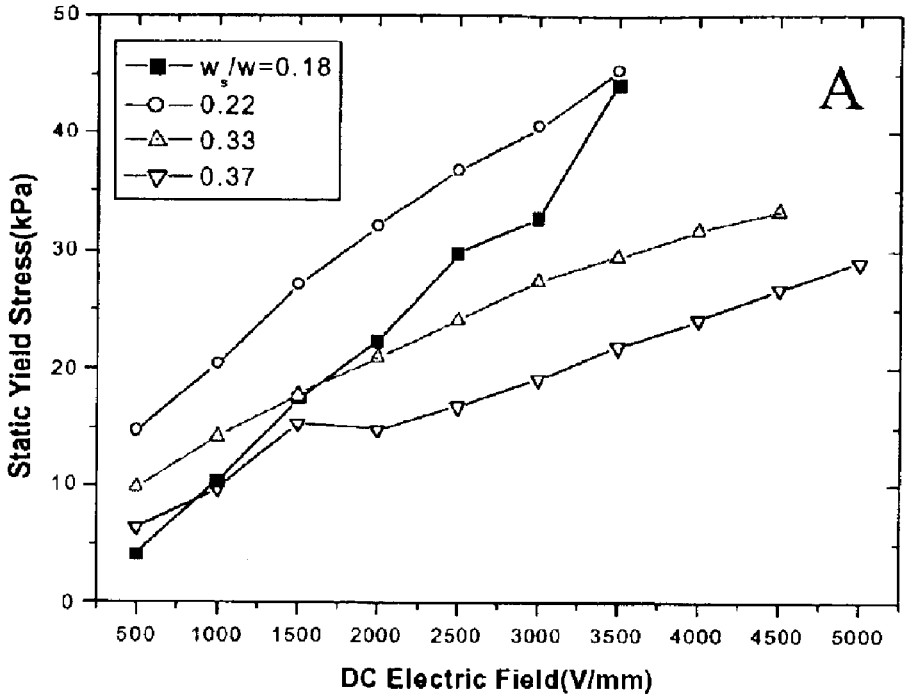
FIG. 7 shows plots of (a) static yield stress and (b) current density as a function of applied DC electric field for four samples of embodiments of the invention with different weight percentages of urea promoter, and FIG. 8 plots the static yield stress as a function of frequency for two embodiments of the invention.
Figure 7:
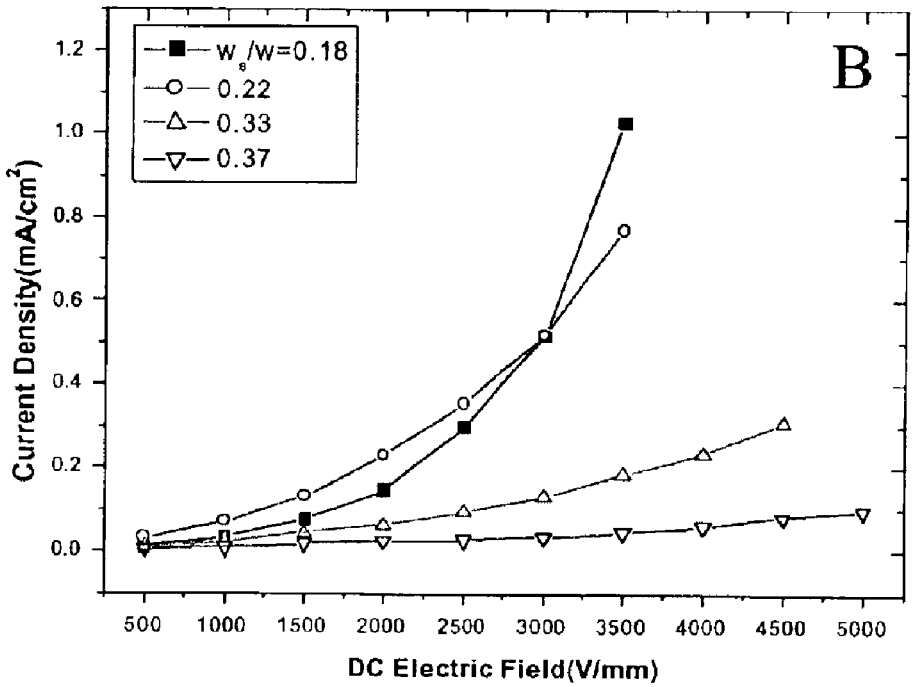

FIG. 7 plots (a) the static yield stress and (b) the current density for four samples of BTR-U with different weight percentages of the promoter (in this case urea). From FIG. 7 it can be seen that a weight percentage of between about 0.18 and 0.22 is preferred.

Figure 8:
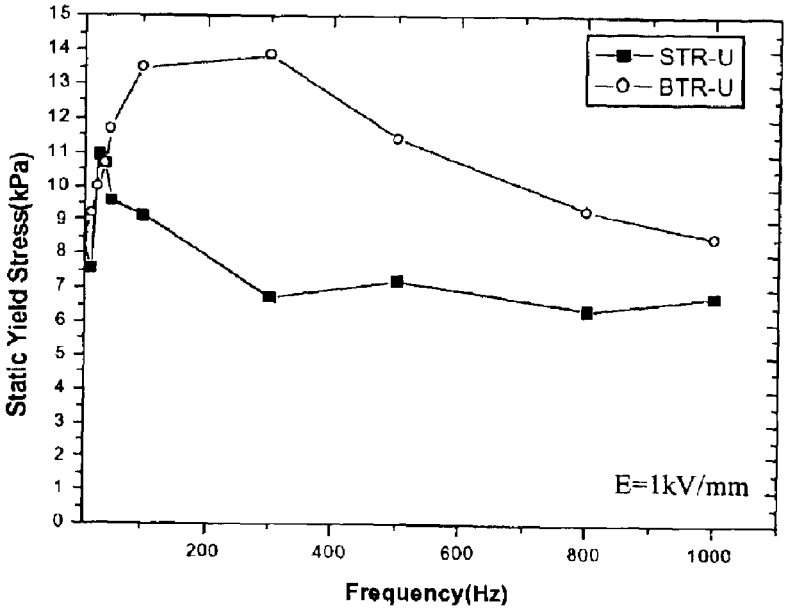

Finally, FIG. 8 plots the static yield stress of two samples STR-U and BTR-U as a function of frequency at a field strength of 1 kV/mm. Although in both cases there is some falling off, there is still good yield stress up to at least 1 kHz, and for the sample STR-U the response is relatively flat.

What is claimed is:

1. An electrorheological fluid comprising particles of a composite material suspended in an electrically insulating hydrophobic liquid, wherein said composite particles are metal salts of the form $M1_xM2_{2-2x}TiO(C_2O_4)_2$ where M1 is selected from the group consisting of Ba, Sr and Ca and wherein M2 is selected from the group consisting of Rb, Li, Na and K, and wherein said composite particles further include a promoter selected from the group consisting of urea, butyramide and acetamide.

2. An electrorheological fluid as claimed in claim 1 wherein x is between 0.94 and 0.96.

3. An electrorheological fluid as claimed in claim 1 wherein the composite particles are suspended in said electrically insulating liquid with a volume fraction of between 0.05 and 0.5.

4. An electrorheological fluid as claimed in claim 1 wherein the promoter comprises between 0.1 and 0.3 percent by weight of the composite particles.

5. An electrorheological fluid as claimed in claim 4 wherein the promoter comprises between 0.18 and 0.22 percent by weight of the composite particles.

6. An electrorheological fluid as claimed in claim 1 wherein said hydrophobic liquid is an oil selected from the group consisting of silicone oil, mineral oils, engine oils and hydrocarbon oils, with a viscosity of between 0.5 and 1.0.

7. An electrorheological system comprising, an electrorheological fluid comprising particles of a composite material suspended in an electrically insulating hydrophobic liquid with a volume fraction of between 0.05 and 0.5, wherein said composite particles are metal salts of the form $M1_xM2_{2-x}TiO(C_2O_4)_2$ where M1 is selected from the group consisting of Ba, Sr and Ca and wherein M2 is selected from the group consisting of Rb, Li, Na and K, and wherein said composite particles further include a promoter selected from the group consisting of urea, butyramide and acetamide, and means for applying to said electrorheological fluid a DC electric field or an AC electrical field with a frequency of less than 1000 Hz.

8. A method of manufacturing composite particles for an electrorheological fluid comprising mixing together a first solution containing M1 ions, a second solution containing M2 ions, a third solution containing Ti ions, dilute oxalic acid and a promoter, wherein M1 is selected from the group consisting of Ba, Sr and Ca, M2 is selected from the group consisting of Rb, Li, Na and K, and the promoter is selected from the group consisting of urea, butyramide, and acetamide.

9. A method as claimed in claim 8 wherein the composite particles are synthesized in an ultrasonic tanker at a temperature between 30° C. and 80° C.

10. A method as claimed in claim 8 wherein the particles are dried at a temperature between 30° C. and 150° C. before use.

* * * * *